US008279243B2

(12) United States Patent
Lin et al.

(10) Patent No.: US 8,279,243 B2
(45) Date of Patent: Oct. 2, 2012

(54) DRIVING CIRCUIT AND A PIXEL CIRCUIT INCORPORATING THE SAME

(75) Inventors: Chih-Lung Lin, Tainan County (TW); Tsung-Ting Tsai, Tainan (TW); Kuo-Chao Liao, Taichung (TW)

(73) Assignee: National Cheng Kung University, Tainan (TW)

( * ) Notice: Subject to any disclaimer, the term of this patent is extended or adjusted under 35 U.S.C. 154(b) by 802 days.

(21) Appl. No.: 12/327,938

(22) Filed: Dec. 4, 2008

(65) Prior Publication Data

US 2009/0146698 A1 Jun. 11, 2009

(30) Foreign Application Priority Data

Dec. 6, 2007 (TW) ..... 96146524 A

(51) Int. Cl.
*G09G 5/10* (2006.01)

(52) U.S. Cl. ..... 345/690; 345/76; 345/77

(58) Field of Classification Search ..... 345/76, 345/77, 92, 93, 212, 690
See application file for complete search history.

(56) References Cited

U.S. PATENT DOCUMENTS

2007/0139314 A1* 6/2007 Park ..... 345/76

* cited by examiner

*Primary Examiner* — Adam R Giesy
(74) *Attorney, Agent, or Firm* — Ladas & Parry LLP

(57) ABSTRACT

A driving circuit includes: a switch unit operable according to a scan signal, and adapted for permitting transfer of a data signal when operating in an on state; a capacitor having a first end that is coupled to the switch unit, and a second end; a first transistor having a first terminal that is adapted for coupling to a voltage source, a second terminal that is coupled to the second end of the capacitor and that is adapted to be coupled to a load, and a control terminal that is coupled to the first end of the capacitor; and a second transistor having a first terminal that is adapted for coupling to the voltage source, a second terminal coupled to the second terminal of the first transistor, and a control terminal that is adapted for receiving a bias voltage. Each of the first and second transistors operates in the linear region.

20 Claims, 5 Drawing Sheets

DRIVING CIRCUIT AND A PIXEL CIRCUIT INCORPORATING THE SAME

CROSS-REFERENCE TO RELATED APPLICATION

This application claims priority of Taiwanese Application No. 096146524, filed on Dec. 6, 2007.

BACKGROUND OF THE INVENTION

1. Field of the Invention

The invention relates to a driving circuit, more particularly to a driving circuit for driving a load, such as a light emitting diode, and a pixel circuit incorporating the same.

2. Description of the Related Art

Organic light emitting diode (OLED) displays are being increasingly widely used due to the advantages of spontaneous emission of light, high luminance, fast response time, and wide viewing angle.

A conventional OLED display utilizes a plurality of pixel circuits that are arranged in matrices and that can emit light of different colors to achieve the function of displaying images. With reference to FIG. 1, a conventional pixel circuit 1 includes an organic light emitting diode (OLED) 11 and a driving circuit 12. The driving circuit 12 generates a driving current ($I_{DRIVE}$). The organic light emitting diode 11 is driven by the driving current ($I_{DRIVE}$) from the driving circuit 12 to emit light with a luminance that corresponds to a magnitude of the driving current ($I_{DRIVE}$).

The driving circuit 12 includes a first transistor 121, a second transistor 122, and a capacitor 123. Each of the first and second transistors 121, 122 is an N-type thin film transistor (TFT), and has a first terminal, a second terminal, and a control terminal.

The organic light emitting diode 11 has a cathode that is adapted for coupling to a first voltage source ($V_{SS}$). The control terminal of the first transistor 121 is adapted for receiving a scan signal (SCAN). The first terminal of the first transistor 121 is adapted for receiving a data signal ($V_{DATA}$). The second terminal of the first transistor 121 is coupled electrically to the control terminal of the second transistor 122. The first terminal of the second transistor 122 is adapted for coupling to a second voltage source ($V_{DD}$). The second terminal of the second transistor 122 is coupled electrically to the second terminal of the first transistor 121 via the capacitor 123, and is coupled electrically to an anode of the organic light emitting diode 11.

Shown in FIG. 2 are timing sequences of the scan signal (SCAN) and the data signal ($V_{DATA}$) for the driving circuit 12 of the conventional pixel circuit 1. When the scan signal (SCAN) is at a logic high level, the first transistor 121 is turned on, such that the data signal ($V_{DATA}$) is transferred to the control terminal of the second transistor 122, and such that the capacitor 123 stores energy from the data signal ($V_{DATA}$). On the other hand, when the scan signal (SCAN) is at a logic low level, the first transistor 121 is turned off. The second transistor 122 operates in the saturation region, and generates the driving current ($I_{DRIVE}$) with reference to the energy stored in the capacitor 123 according to the following formula:

$$I_{DRIVE} = \frac{1}{2}k_{122}(V_{C,123} - V_{TH,122})^2$$

where ($k_{122}$) is a device transconductance parameter of the second transistor 122, ($V_{C,123}$) is the voltage across the capacitor 123, and ($V_{TH,122}$) is a threshold voltage for the second transistor 122.

Since the threshold voltages of the second transistors 122 for individual pixel circuits 1 are not identical, the driving currents ($I_{DRIVE}$) generated by the pixel circuits 1 differ from each other even with the same data signal ($V_{DATA}$), thereby resulting in luminance variations among the light emitted by the organic light emitting diodes 11.

Several techniques have been developed in order to diminish the effect of the threshold voltage differences on driving current ($I_{DRIVE}$) variations and involve adding more transistors and/or capacitors in the driving circuit. However, as the number of components increases, an aperture ratio (i.e., a ratio of coverage area of effective illuminating display region) of the OLED display utilizing these types of driving circuits is reduced. Consequently, utilization efficiency of the light is diminished. Moreover, in these driving circuits, the transistor that generates the driving current ($I_{DRIVE}$) operates in the saturation region, thereby increasing power consumption.

SUMMARY OF THE INVENTION

Therefore, the object of the present invention is to provide a driving circuit that can minimize the effect of threshold voltage variations and that can reduce power consumption thereof, and a pixel circuit incorporating the driving circuit.

According to one aspect of the present invention, there is provided a pixel circuit that includes a light emitting diode and a driving circuit. The light emitting diode has an anode that receives a driving current, and a cathode that is adapted for coupling to a first voltage source. The driving circuit includes a switch unit, a capacitor, a first transistor, and a second transistor. The switch unit is operable in one of an on state and an off state according to a scan signal, and is adapted for permitting transfer of a data signal when operating in the on state. The capacitor has a first end that is coupled electrically to the switch unit, and a second end. The first transistor has a first terminal that is adapted for coupling to a second voltage source, a second terminal that is coupled electrically to the second end of the capacitor and to the anode of the light emitting diode, and a control terminal that is coupled electrically to the first end of the capacitor. The second transistor has a first terminal that is adapted for coupling to the second voltage source, a second terminal coupled electrically to the second terminal of the first transistor, and a control terminal that is adapted for receiving a bias voltage. Each of the first and second transistors operates in the linear region.

According to another aspect of the present invention, there is provided a driving circuit for driving a load. The driving circuit includes a switch unit, a capacitor, a first transistor, and a second transistor. The switch unit is operable in one of an on state and an off state according to a scan signal, and is adapted for permitting transfer of a data signal when operating in the on state. The capacitor has a first end that is coupled electrically to the switch unit, and a second end. The first transistor has a first terminal that is adapted for coupling to a voltage source, a second terminal that is coupled electrically to the second end of the capacitor and that is adapted to be coupled to the load, and a control terminal that is coupled electrically to the first end of the capacitor. The second transistor has a first terminal that is adapted for coupling to the voltage source, a second terminal coupled electrically to the second terminal of the first transistor, and a control terminal that is adapted for receiving a bias voltage. Each of the first and second transistors operates in the linear region.

According to yet another aspect of the present invention, there is provided a pixel circuit that includes a light emitting diode and a driving circuit. The light emitting diode is driven by a driving current. The driving circuit includes a switch unit, a capacitor, a first transistor, and a second transistor. The switch unit is operable in one of an on state and an off state according to a scan signal, and is adapted for permitting transfer of a data signal when operating in the on state. The capacitor is coupled electrically to the switch unit, and stores energy from the data signal when the switch unit operates in the on state. The first transistor is coupled electrically to the capacitor, operates in the linear region, and generates a first current according to the energy stored in the capacitor. The second transistor is connected in parallel to the first transistor, operates in the linear region, and generates a second current according to a bias signal. The driving current is drawn from the first and second currents for driving operation of the light emitting diode.

According to still another aspect of the present invention, there is provided a driving circuit for driving a load. The driving circuit includes a switch unit, a capacitor, a first transistor, and a second transistor. The switch unit is operable in one of an on state and an off state according to a scan signal, and is adapted for permitting transfer of a data signal when operating in the on state. The capacitor is coupled electrically to the switch unit, and stores energy from the data signal when the switch unit operates in the on state. The first transistor is coupled electrically to the capacitor, operates in the linear region, and generates a first current according to the energy stored in the capacitor. The second transistor is connected in parallel to the first transistor, operates in the linear region, and generates a second current according to a bias signal. A driving current is drawn from the first and second currents for driving operation of the load.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 3:
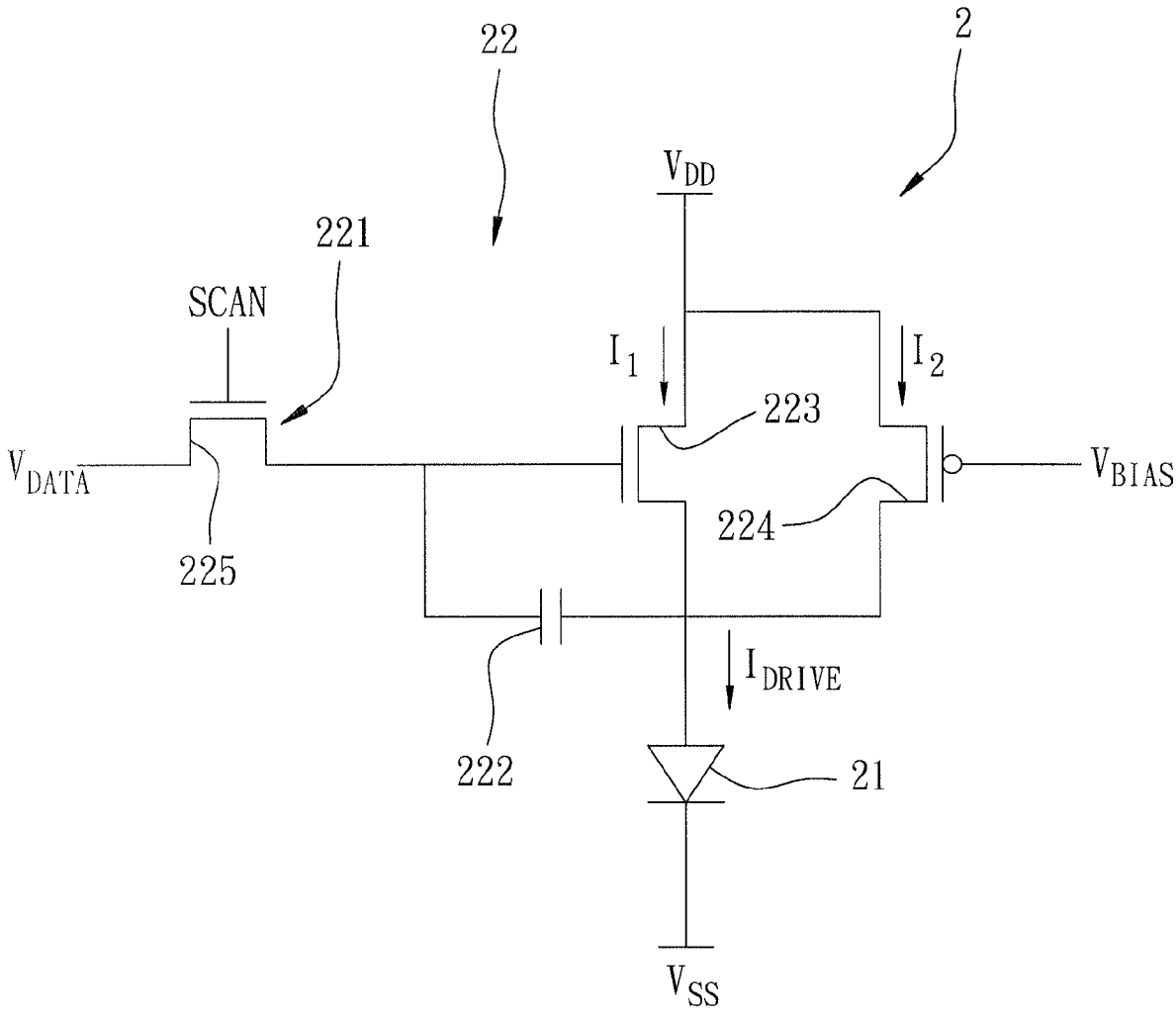
FIG. 3 is an electrical circuit diagram of the preferred embodiment of a pixel circuit according to the present invention.

As shown in FIG. 3, the preferred embodiment of a pixel circuit 2 according to the present invention includes a light emitting diode 21 and a driving circuit 22. The light emitting diode 21 has an anode that receives a driving current ($I_{DRIVE}$), and a cathode that is adapted for coupling to a first voltage source ($V_{SS}$). In this embodiment, the light emitting diode 21 is an organic light emitting diode (OLED). The driving circuit 22 includes a switch unit 221, a capacitor 222, a first transistor 223, and a second transistor 224.

The switch unit 221 is operable in one of an on state and an off state according to a scan signal (SCAN), and is adapted for permitting transfer of a data signal ($V_{DATA}$) when operating in the on state.

The capacitor 222 has a first end that is coupled electrically to the switch unit 221, and a second end.

The first transistor 223 has a first terminal that is adapted for coupling to a second voltage source ($V_{DD}$) a second terminal that is coupled electrically to the anode of the light emitting diode 21 and to the second end of the capacitor 222, and a control terminal that is coupled electrically to the first end of the capacitor 222.

The second transistor 224 has a first terminal that is adapted for coupling to the second voltage source ($V_{DD}$), a second terminal that is coupled electrically to the second terminal of the first transistor 223, and a control terminal that is adapted for receiving a bias voltage ($V_{BIAS}$). The second transistors 224 is thus connected in parallel to the first transistor 223.

In this embodiment, the switch unit 221 includes a third transistor 225 having a first terminal that is adapted for receiving the data signal ($V_{DATA}$), a second terminal that is coupled electrically to the control terminal of the first transistor 223, and a control terminal that is adapted for receiving the scan signal (SCAN). Each of the first and third transistors 223, 225 is one of an N-type thin film transistor (TFT) and an N-type metal oxide semiconductor (MOS), and the second transistor 224 is one of a P-type thin film transistor (TFT) and a P-type metal oxide semiconductor (MOS). In this embodiment, each of the first and third transistors 223, 225 is an N-type TFT, and the second transistor 224 is a P-type TFT.

Figure 4:
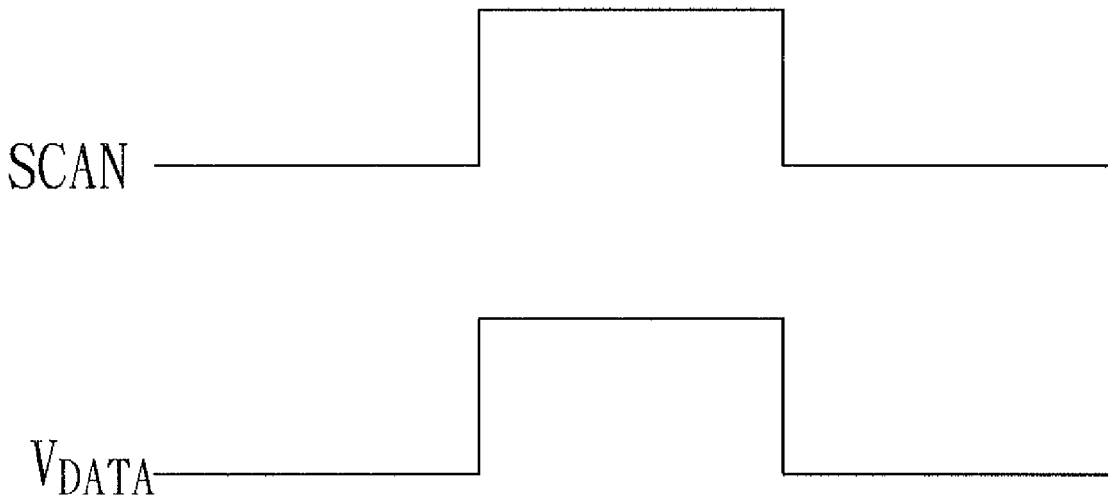
FIG. 4 illustrates timing sequences of SCAN and $V_{DATA}$ signals for the preferred embodiment.

Shown in FIG. 4 are timing sequences of the scan signal (SCAN) and the data signal ($V_{DATA}$) for the driving circuit 22. When the scan signal (SCAN) is at a logic high level, the third transistor 225 is turned on (i.e., the switch unit 221 operates in the on state), thereby permitting transfer of the data signal ($V_{DATA}$) to the control terminal of the first transistor 223 such that the capacitor 222 stores energy from the data signal ($V_{DATA}$). When the scan signal (SCAN) is at a low logic level, the third transistor 225 is turned off (i.e., the switch unit 221 operates in the off state), and the first transistor 223 operates in the linear region, and generates a first current ($I_1$) according to the energy stored in the capacitor 222. The second transistor 224 also operates in the linear region, and generates a second current ($I_2$) from the bias voltage ($V_{BIAS}$). The first and second currents ($I_1$, $I_2$) are combined as the driving current ($I_{DRIVE}$) that drives the operation of the light emitting diode 21.

The first current ($I_1$), the second current ($I_2$), and the driving current ($I_{DRIVE}$) are respectively generated according to the following formulae:

$$I_1 = \frac{1}{2}k_{223}\left[(V_{DATA} - V_{LED} - V_{THN,223})(V_{DD} - V_{OLED}) - \frac{1}{2}(V_{DD} - V_{OLED})^2\right]$$

$$I_2 = \frac{1}{2}k_{224}\left[(V_{DD} - V_{BIAS} + V_{THP,224})(V_{DD} - V_{OLED}) - \frac{1}{2}(V_{DD} - V_{OLED})^2\right]$$

$$I_{DRIVE} = I_1 + I_2$$

where $k_{223}$ is a device transconductance parameter of the first transistor 223, $V_{THN,223}$ is a threshold voltage for the first transistor 223, $k_{224}$ is a device transconductance parameter of the second transistor 224, $V_{THP,224}$ is a threshold voltage for the second transistor 224, and $V_{OLED}$ is a voltage at the anode of the light emitting diode 21.

The following formula can be used to estimate a level of influence on the driving current ($I_{DRIVE}$) due to threshold voltage variations:

$$\partial I_{DRIVE} = -k_{223}(V_{DD} - V_{OLED})\partial V_{THN,233} + k_{224}(V_{DD} - V_{OLED})\partial V_{THP,244} = -\mu_n C_{ox}\frac{W_{223}}{L_{223}}(V_{DD} - V_{OLED})\partial V_{THN,233} + \mu_p C_{ox}\frac{W_{224}}{L_{224}}(V_{DD} - V_{OLED})\partial V_{THP,244}$$

where $W_{223}$ and $L_{223}$ are respectively a width and a length of the first transistor 223, and $W_{224}$ and $L_{224}$ are respectively a width and a length of the second transistor 224.

Therefore, by adjusting the width-to-length ratios of the first and second transistors 223, 224 such that the device transconductance parameters of the first and second transistors 223, 224 are substantially identical, the effect of the threshold voltage variations on the driving current ($I_{DRIVE}$) can be eliminated. As a result, the driving circuits 22 of different pixel circuits 2 of the present invention can generate substantially identical driving currents ($I_{DRIVE}$) when the data signals ($V_{DATA}$) supplied thereto are the same, thereby resulting in substantially identical luminance intensity of light emitted by the light emitting diodes 21.

Figure 5:
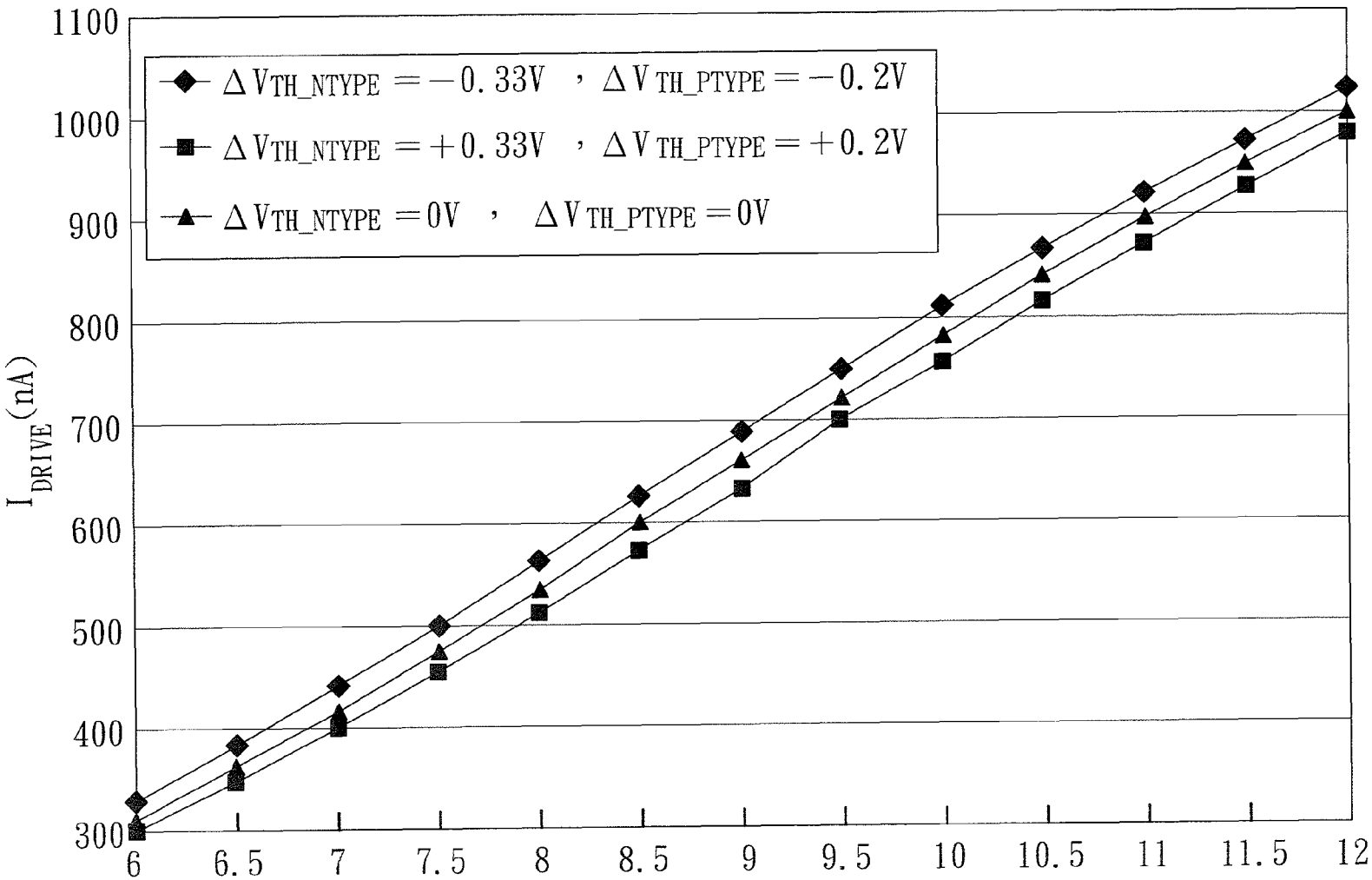
FIG. 5 shows simulation results for driving currents generated by the driving circuit of the preferred embodiment under three different conditions.

Assuming that the first voltage source ($V_{SS}$) is −6V, the second voltage source ($V_{DD}$) is 5V, the logic high level of the scan signal (SCAN) is 15V, the logic low level of the scan signal (SCAN) is −15V, the data signal ($V_{DATA}$) has a voltage range of between 6V and 12V, the bias voltage ($V_{BIAS}$) is 0V, the width-to-length ratio ($W_{223}/L_{223}$) of the first transistor 223 is 50 μm/4 μm, the width-to-length ratio ($W_{224}/L_{224}$) of the second transistor 224 is 50 μm/4 μm, the width-to-length ratio ($W_{225}/L_{225}$) of the third transistor 225 is 6 μm/6 μm, and the capacitance of the capacitor 222 is 0.3 pF, FIG. 5 shows simulation results for the driving currents ($I_{DRIVE}$) under three different conditions, i.e., when the threshold voltage drifts for the first and third transistors 223, 225 are −0.33V, and for the second transistor 224 is −0.2V, when the threshold voltage drifts for the first and third transistors 223, 225 are 0V, and for the second transistor 224 is 0V, and when the threshold voltage drifts for the first and third transistors 223, 225 are +0.33V, and for the second transistor 224 is +0.2V. As can be seen from FIG. 5, the driving currents ($I_{DRIVE}$) for the different conditions, which are the differences that would exist among different pixel circuits 2, are substantially identical.

It should be noted herein that other than the light emitting diode 21, the driving circuit 22 can also be used for driving other loads.

Figure 1:
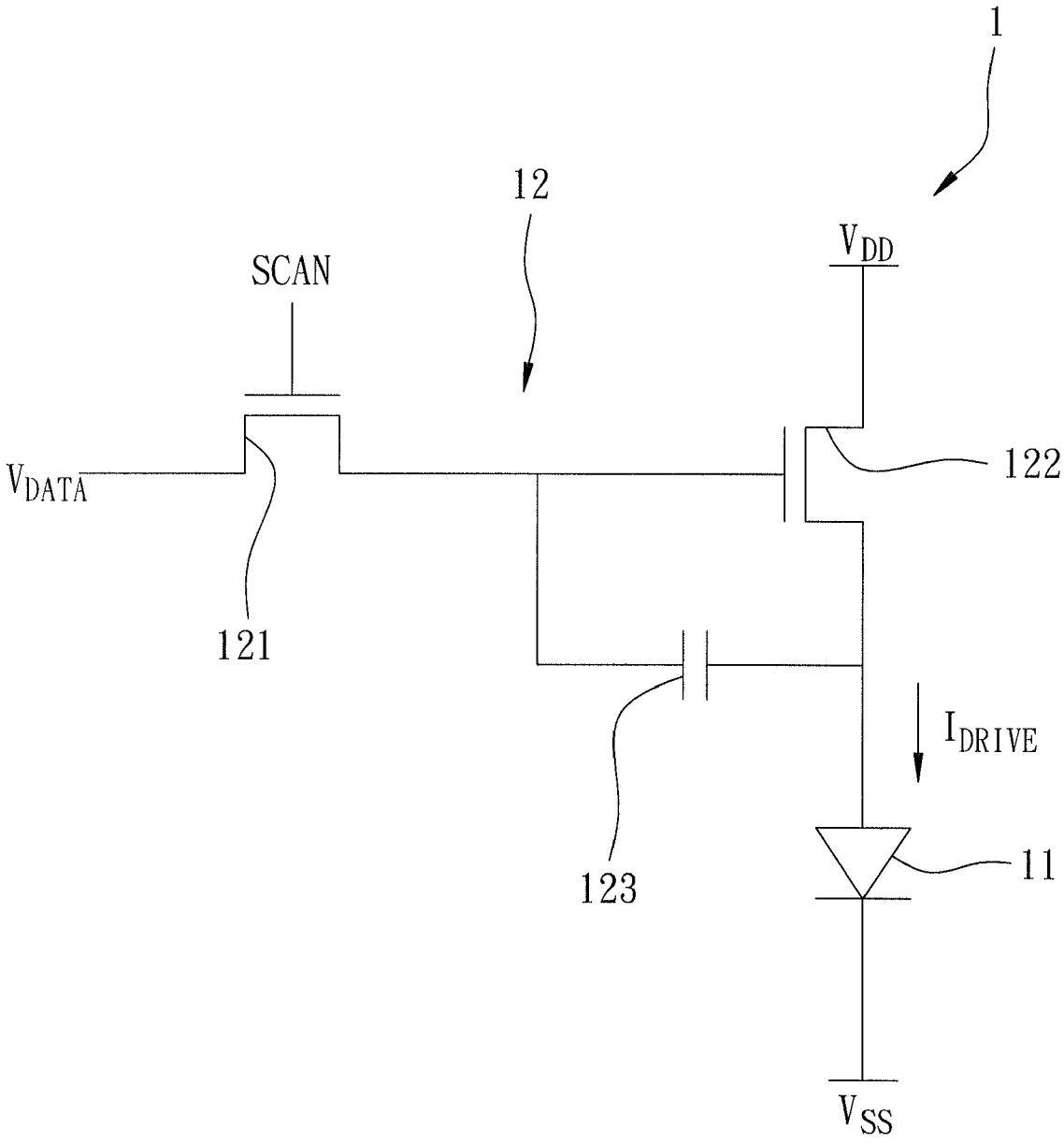
FIG. 1 PRIOR ART
FIG. 1 is an electrical circuit diagram of a conventional pixel circuit.
Figure 2:
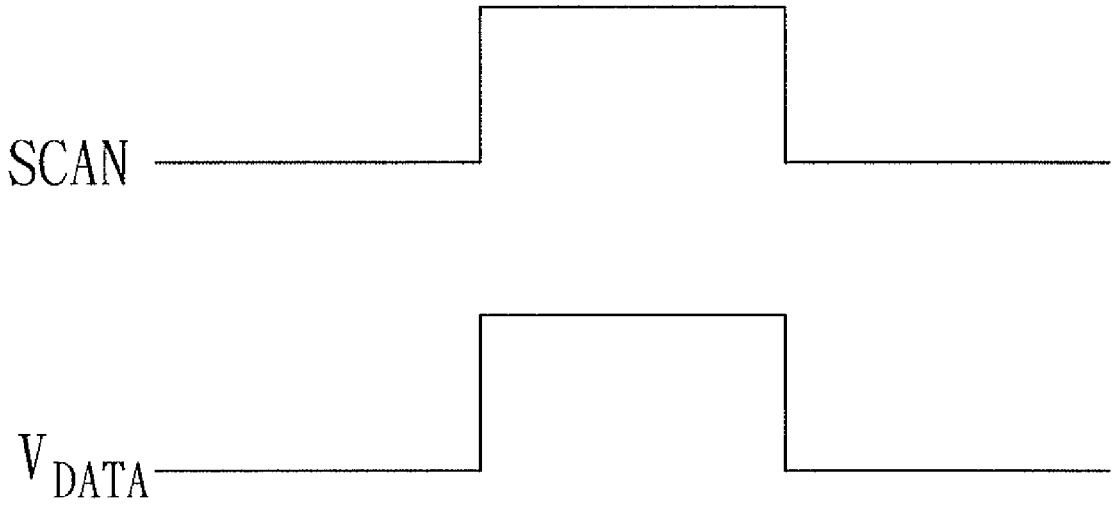
FIG. 2 PRIOR ART
FIG. 2 illustrates timing sequences of SCAN and $V_{DATA}$ signals for a driving circuit of the conventional pixel circuit of FIG. 1.

In summary, the present invention utilizes the second transistor 224 to vary the effect of threshold voltage variation on the driving current ($I_{DRIVE}$), such that the effect of the threshold voltage variations on the driving current ($I_{DRIVE}$) can be eliminated when the device transconductance parameters for the first and second transistors 223, 224 are substantially identical. Consequently, the driving currents ($I_{DRIVE}$) generated by different driving circuits 22 for driving different light emitting diodes 21 are substantially identical, thereby resulting in substantially identical luminance among the light emitting diodes 21. Moreover, by operating the first and second transistors 223, 224 in the linear region, power consumption is reduced. Furthermore, only one more transistor is used in the pixel circuit 2 of the present invention as compared to the conventional pixel circuit 1 of FIG. 1, thereby minimizing the reduction in aperture ratio as compared to other modified pixel circuits in the prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pixel circuit comprising:

a light emitting diode having an anode that receives a driving current, and a cathode that is adapted for coupling to a first voltage source; and a driving circuit including:

a switch unit operable in one of an on state and an off state according to a scan signal, and adapted for permitting transfer of a data signal when operating in the on state;

a capacitor having a first end that is coupled electrically to said switch unit, and a second end;

a first transistor having a first terminal that is adapted for coupling to a second voltage source, a second terminal that is coupled electrically to said second end of said capacitor and to said anode of said light emitting diode, and a control terminal that is coupled electrically to said first end of said capacitor; and a second transistor having a first terminal that is adapted for coupling to the second voltage source, a second terminal coupled electrically to said second terminal of said first transistor, and a control terminal that is adapted for receiving a bias voltage;

wherein each of said first and second transistors operates simultaneously in the linear region.

2. The pixel circuit as claimed in claim 1, wherein said first transistor is one of an N-type thin film transistor and an N-type metal oxide semiconductor, and said second transistor is one of a P-type thin film transistor and a P-type metal oxide semiconductor.

3. The pixel circuit as claimed in claim 1, wherein said switch unit includes a third transistor having a first terminal that is adapted for receiving the data signal, a second terminal that is coupled electrically to said control terminal of said first transistor, and a control terminal that is adapted for receiving the scan signal.

4. The pixel circuit as claimed in claim 3, wherein each of said first and third transistors is one of an N-type thin film transistor and an N-type metal oxide semiconductor, and said second transistor is one of a P-type thin film transistor and a P-type metal oxide semiconductor.

5. The pixel circuit as claimed in claim 1, wherein said first and second transistors have substantially identical device transconductance parameters.

6. The pixel circuit as claimed in claim 1, wherein said light emitting diode is an organic light emitting diode (OLED).

7. A driving circuit for driving a load, comprising:

a switch unit operable in one of an on state and an off state according to a scan signal, and adapted for permitting transfer of a data signal when operating in the on state;

a capacitor having a first end that is coupled electrically to said switch unit, and a second end;

a first transistor having a first terminal that is adapted for coupling to a voltage source, a second terminal that is coupled electrically to said second end of said capacitor and that is adapted to be coupled to the load, and a control terminal that is coupled electrically to said first end of said capacitor; and a second transistor having a first terminal that is adapted for coupling to the voltage source, a second terminal coupled electrically to said second terminal of said first transistor, and a control terminal that is adapted for receiving a bias voltage;

wherein each of said first and second transistors operates simultaneously in the linear region.

8. The driving circuit as claimed in claim 7, wherein said first transistor is one of an N-type thin film transistor and an N-type metal oxide semiconductor, and said second transistor is one of a P-type thin film transistor and a P-type metal oxide semiconductor.

9. The driving circuit as claimed in claim 7, wherein said switch unit includes a third transistor having a first terminal that is adapted for receiving the data signal, a second terminal that is coupled electrically to said control terminal of said first transistor, and a control terminal that is adapted for receiving the scan signal.

10. The driving circuit as claimed in claim 9, wherein each of said first and third transistors is one of an N-type thin film transistor and an N-type metal oxide semiconductor, and said second transistor is one of a P-type thin film transistor and a P-type metal oxide semiconductor.

11. The driving circuit as claimed in claim 7, wherein said first and second transistors have substantially identical device transconductance parameters.

12. A pixel circuit comprising:

a light emitting diode that is driven by a driving current; and a driving circuit including:

a switch unit that is operable in one of an on state and an off state according to a scan signal, and that is adapted for permitting transfer of a data signal when operating in the on state;

a capacitor that is coupled electrically to said switch unit, and that stores energy from the data signal when said switch unit operates in the on state;

a first transistor that is coupled electrically to said capacitor, that operates in the linear region, and that generates a first current according to the energy stored in said capacitor; and a second transistor that is connected in parallel to said first transistor, that operates in the linear region, and that generates a second current according to a bias signal, and wherein each of said first and second transistors operates simultaneously in the linear region;

wherein the driving current is drawn from the first and second currents for driving operation of said light emitting diode.

13. The pixel circuit as claimed in claim 12, wherein said first and second transistors are complementary to each other.

14. The pixel circuit as claimed in claim 12, wherein said first transistor is one of an N-type thin film transistor and an N-type metal oxide semiconductor, and said second transistor is one of a P-type thin film transistor and a P-type metal oxide semiconductor.

15. The pixel circuit as claimed in claim 12, wherein said first and second transistors have substantially identical device transconductance parameters.

16. The pixel circuit as claimed in claim 12, wherein said light emitting diode is an organic light emitting diode (OLED).

17. A driving circuit for driving a load, comprising:

a switch unit that is operable in one of an on state and an off state according to a scan signal, and that is adapted for permitting transfer of a data signal when operating in the on state;

a capacitor that is coupled electrically to said switch unit, and that stores energy from the data signal when said switch unit operates in the on state;

a first transistor that is coupled electrically to said capacitor, that operates in the linear region, and that generates a first current according to the energy stored in said capacitor; and a second transistor that is connected in parallel to said first transistor, that operates in the linear region, and that generates a second current according to a bias signal, and wherein each of said first and second transistors operates simultaneously in the linear region;

wherein a driving current is drawn from the first and second currents for driving operation of the load.

18. The driving circuit as claimed in claim 17, wherein said first and second transistors are complementary to each other.

19. The driving circuit as claimed in claim 17, wherein said first transistor is one of an N-type thin film transistor and an N-type metal oxide semiconductor, and said second transistor is one of a P-type thin film transistor and a P-type metal oxide semiconductor.

20. The pixel circuit as claimed in claim 17, wherein said first and second transistors have substantially identical device transconductance parameters.

* * * * *